US007472854B1

(12) United States Patent
Bird

(10) Patent No.: US 7,472,854 B1
(45) Date of Patent: Jan. 6, 2009

(54) BRUSH CHIPPER HAVING IMPROVED MECHANICAL COUPLING ARRANGEMENT FOR FEED MOTOR

(75) Inventor: John T. Bird, Greenville, SC (US)

(73) Assignee: BB&F Enterprises, LLC, Spartanburg, SC (US)

( * ) Notice: Subject to any disclaimer, the term of this patent is extended or adjusted under 35 U.S.C. 154(b) by 206 days.

(21) Appl. No.: 11/179,017

(22) Filed: Jul. 11, 2005

(51) Int. Cl.
*B02C 17/02* (2006.01)

(52) U.S. Cl. ..... 241/92; 241/225

(58) Field of Classification Search ..... 241/92, 241/186.2, 225; 403/374.1–374.4, 409.1, 403/355, 356, 16, 286, 297
See application file for complete search history.

(56) References Cited

U.S. PATENT DOCUMENTS

| | | | | |
|---|---|---|---|---|
| 3,989,198 | A | 11/1976 | Blasko | |
| 4,260,114 | A * | 4/1981 | Herder | 241/37.5 |
| 4,504,019 | A | 3/1985 | Newell et al. | |
| 4,598,745 | A | 7/1986 | Parviainen | |
| 4,721,257 | A | 1/1988 | Williams et al. | |
| 4,796,819 | A | 1/1989 | Waterman | |
| 5,088,532 | A | 2/1992 | Eggers et al. | |
| 5,975,169 | A * | 11/1999 | Jonkka et al. | 144/373 |
| 5,988,539 | A | 11/1999 | Morey | |
| 6,016,855 | A | 1/2000 | Morey | |
| 6,032,707 | A | 3/2000 | Morey et al. | |
| 6,357,684 | B1 | 3/2002 | Morey | |
| 6,722,596 | B1 | 4/2004 | Morey | |
| 6,729,567 | B1 | 5/2004 | Morey | |
| 6,814,320 | B1 | 11/2004 | Morey et al. | |
| 6,830,204 | B1 | 12/2004 | Morey | |
| 7,121,488 | B1 | 10/2006 | Marriott et al. | |
| 2002/0070301 | A1 | 6/2002 | Stelter et al. | |

FOREIGN PATENT DOCUMENTS

| | | | |
|---|---|---|---|
| DE | 20210161 U1 | * | 5/2002 |
| JP | 842582 | * | 2/1996 |

* cited by examiner

*Primary Examiner*—Faye Francis
(74) *Attorney, Agent, or Firm*—Nelson Mullins Riley & Scarborogh, LLP

(57) ABSTRACT

A brush chipper includes a mechanical coupling arrangement for connecting a motor output shaft to a feed wheel shaft of the same machine. The coupling arrangement includes a mechanical coupler, a motor output shaft, a feed wheel shaft, and a tapered bushing. The arrangement is configured to securely and removeably connect the motor output shaft to the feed wheel shaft.

6 Claims, 4 Drawing Sheets

BRUSH CHIPPER HAVING IMPROVED MECHANICAL COUPLING ARRANGEMENT FOR FEED MOTOR

BACKGROUND OF THE INVENTION

The present invention relates generally to brush chippers, and more particularly to a novel arrangement for coupling a brush chipper's motor output shaft to the feed wheel shaft of the same machine.

Generally, brush chippers are comprised of a feed system and a cutting system. The feed system includes an opening into which brush is inserted. Feed wheels within the opening rotate to pull the brush into the cutting system. The cutting system includes a mechanism for cutting the brush into small chips which are then discharged.

The feed wheels are often formed as opposed drums (or cylinders) providing a nip into which the brush is received. Typically, each of the feed wheel drums has a drive shaft driven by a respective hydraulic motor. In the past, a variety of coupling arrangements have been provided to connect the motor output shaft to the drive shaft of the feed wheel drum. These prior arrangements, however, have each had significant drawbacks in either the operation or serviceability of the brush chipper.

For example, those in the art have conventionally used couplers employing two pins extending through the coupler and into the respective shafts being joined. That is, the coupler and each shaft would have radial bores (one on each end of the coupler and one in each shaft) in which respective pins were inserted. An interference fit between the pins and bore walls would create a connection between the shafts via the coupler. Unfortunately, upon failure of the motor, the coupler, or either of the shafts, it was difficult to separate the shafts from the coupler. Often, the only way to remove the coupler was to destroy it. As a result, the coupler and connected parts were often damaged beyond repair.

Another prior art technique of connecting the feed wheel drive shaft and motor output shaft was to use a chain coupler. This arrangement, while easily removable, sometimes suffers from a strength deficiency. That is, the forces transmitted from the motor output shaft to the feed wheel shaft can be too high to be transferred reliably through a chain coupler. Yet another technique, connecting straight motor output and feed wheel shafts with a coupler having keyways, is often unsatisfactory because the keys may not be sufficiently strong by themselves to prevent shearing.

SUMMARY

The present invention recognizes and addresses considerations of prior art constructions and methods.

According to one aspect, the present invention provides a coupling arrangement for a brush chipper comprising a motor output shaft, a feed wheel shaft, and first and second interconnected coupling elements. The first coupling element has a substantially cylindrical body extending along a longitudinal axis between first and second ends thereof. Optionally, the first coupling element also may have a tapered first bore extending partially into the coupling element from the first end of the cylindrical body. The first bore is preferably tapered so that its inner diameter is the greatest at the first end of the cylindrical body.

In addition, the coupler may have a second bore extending into the cylindrical body from the second end thereof. In a preferred embodiment, the second bore has a smaller average diameter than the first bore and extends into the cylindrical body such that the second bore intersects the first bore. The second bore may be tapered so that its inner diameter is greatest at the second end of the cylindrical body. The motor output shaft may be tapered to create a substantially tight fit when mounted in the second bore.

A feed wheel shaft extends from a feed wheel of a brush chipper and is connected to the first coupling element by the second coupling element. In this regard, the second coupling element may take the form of a bushing having a tapered portion received into the first bore of the first coupling element. In addition, in a preferred embodiment, the bushing has a flange about the outer circumference of its first end and a bore through its center. The bushing also preferably defines an axial slot producing contraction when the bushing is moved axially into the first coupling element. As a result, the bushing will tightly grip the feed wheel drive shaft.

A nut may be threaded onto the end of the motor output shaft to help hold the first coupling element to the motor output shaft. In this regard, the nut is configured and sized to fit within the first bore and pull the first coupling element onto the motor output shaft upon tightening of the nut.

The accompanying drawings, incorporated in and constituting part of this specification, illustrate one or more embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended drawings, in which.

Figure 1:
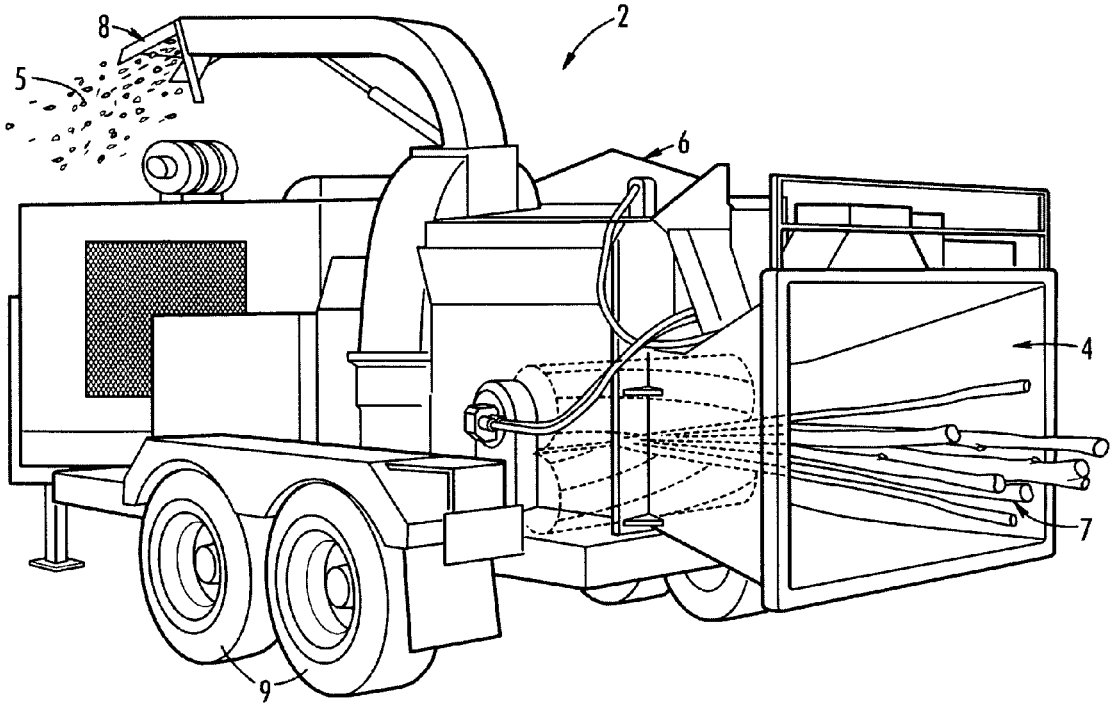
FIG. 1 is a perspective view of a brush chipper which may be equipped with a mechanical coupling arrangement of the present invention.

Repeat use of reference characters in the present specification and drawings is intended to represent same or analogous features or elements of the invention.

DETAILED DESCRIPTION OF THE PREFERRED EMBODIMENTS

Reference will now be made in detail to presently preferred embodiments of the invention, one or more examples of which are illustrated in the accompanying drawings. Each example is provided by way of explanation of the invention, not limitation of the invention. In fact, it will be apparent to those skilled in the art that modifications and variations can be made in the present invention without departing from the scope and spirit thereof. For instance, features illustrated or described as part of one embodiment may be used on another embodiment to yield a still further embodiment. Thus, it is intended that the present invention covers such modifications and variations as come within the scope of the appended claims and their equivalents.

Referring to the drawings, and particularly to FIG. 1, a brush chipper 2 is shown. Brush chipper 2 has a feed opening 4, a cutting system within a body 6, and a brush outlet 8. Wheels 9 are provided so that brush chipper 2 may be moved from site to site. In operation, brush 7 is fed through opening 4 where it is engaged by the opposed feed wheels (shown in phantom). The feed wheels function to draw brush 7 into the cutting system. The resulting chips 5 are expelled from brush outlet 8 and collected in any desired receptacle for disposal.

Figure 2:
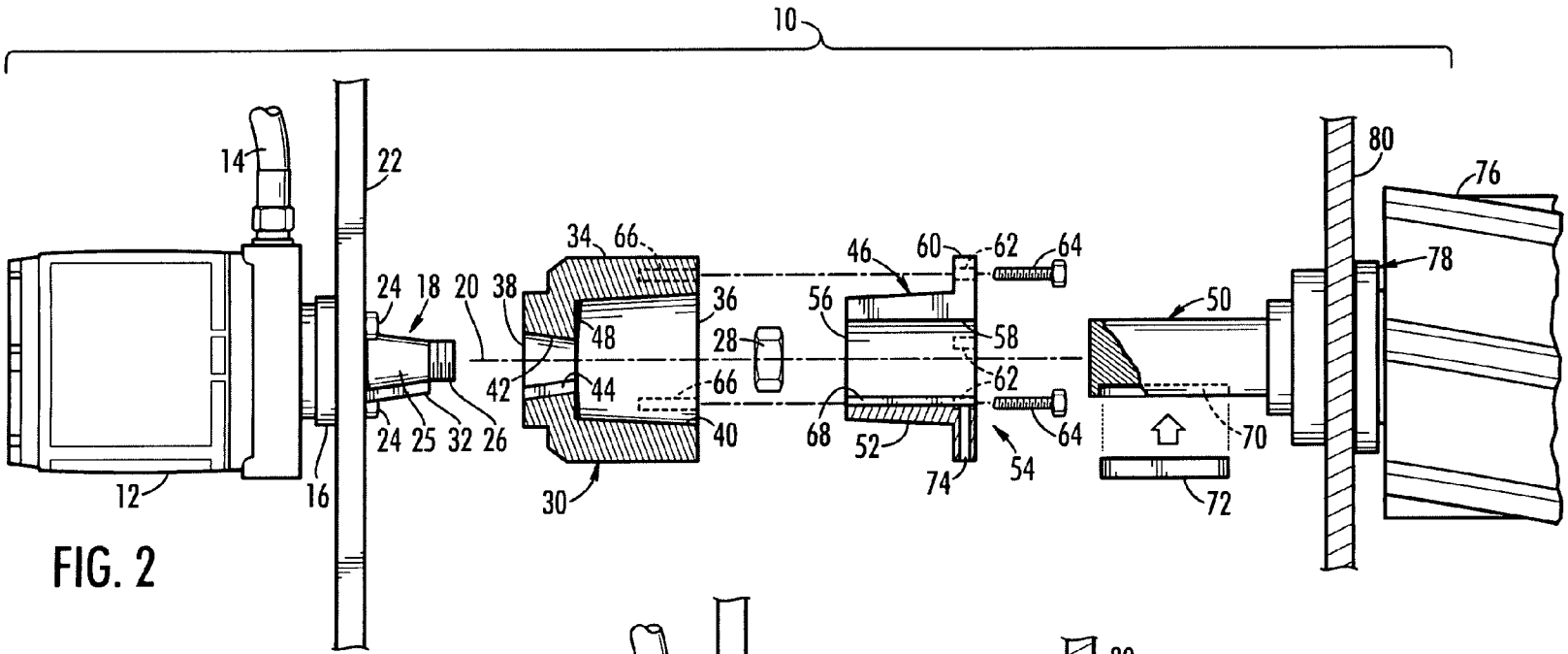
FIG. 2 is an exploded view of a coupling arrangement in accordance with the present invention with certain components shown in section or partially cut away.
Figure 3:
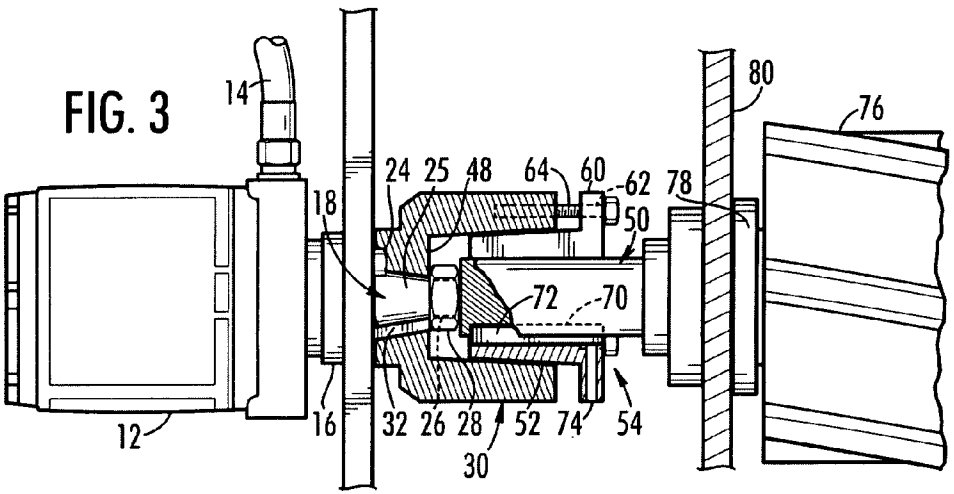
FIG. 3 is an assembled view of the coupling arrangement shown in FIG. 2.

Referring to FIGS. 2 and 3, a coupling arrangement 10 for use in the brush chipper 2 is shown. A hydraulic motor 12 is powered by hydraulic fluid from intake line 14, with the fluid exiting the motor through a return line (not shown). Motor 12 has a mounting flange 16 through which motor output shaft 18 protrudes. Upon application of pressure to the fluid in intake line 14, motor 12 spins motor output shaft 18 about the shaft's centerline axis 20.

Mounting flange 16 is attached to a torque arm 22 with bolts 24 or other suitable means of attachment. The purpose of the torque arm is to resist twisting of the motor during motor use. Typically, torque arm 22 is not directly connected to the body of the brush chipper. Instead, coupling arrangement 10 may support the weight of motor 12 and torque arm 22. Torque arm 22 engages the frame of the brush chipper in a manner that allows it to rotate slightly before contact. This connection help to reduce bending moments on the coupling arrangement, particularly motor output shaft 18. In this regard, the chipper is preferably designed to quickly reverse the rotational direction of the feed wheels to clear jams and then reverse directions again to continue feeding. These reversals of direction apply large impact loads to the system; the design of torque arm 22 decreases the maximum loading applied to the motor from these changes in rotational direction.

In the embodiment shown in FIGS. 2 and 3, motor output shaft 18 includes a tapered portion 25 and a threaded portion 26 at its distal end. Threaded portion 26 mates with nut 28 used to retain first coupling element 30 on shaft 18 upon tightening. A key 32 is provided on the outside of tapered portion 25. In this embodiment, key 32 is a separate piece that fits into a matching keyway in tapered shaft 18.

Coupling element 30 has a substantially cylindrical body 34, a first end 36, and an opposite second end 38. A tapered first bore 40 extends into cylindrical body 34 from first end 36. A tapered second bore 42 likewise extends into cylindrical body 34 from second end 38. A keyway 44 formed in second bore 42 mates with key 32 to prevent relative rotation between shaft 18 and coupling element 30. It should be appreciated that the connection between shaft 18 and coupler 30 could also be accomplished through the use of a slotted bushing. That is, coupler 30 could be configured to accept bushings at both its first end 36 and second end 38. Generally, shaft 18 would be a straight shaft in such an embodiment.

A second coupling element, here in the form of a bushing 46, is provided to connect first coupling element 30 to feed wheel shaft 50. Bushing 46 has a substantially cylindrical body with a tapered outside surface 52. For reference, bushing 46 has a first end 54 and an opposite second end 56. A bore 58 extends through bushing 46 to accept feed wheel shaft 50. In this case, bore 58, like shaft 50, is not tapered. One skilled in the art will appreciate that nut 28 may be sized to be received in bore 58 when bushing 46 is inserted into first bore 40.

Figure 4:
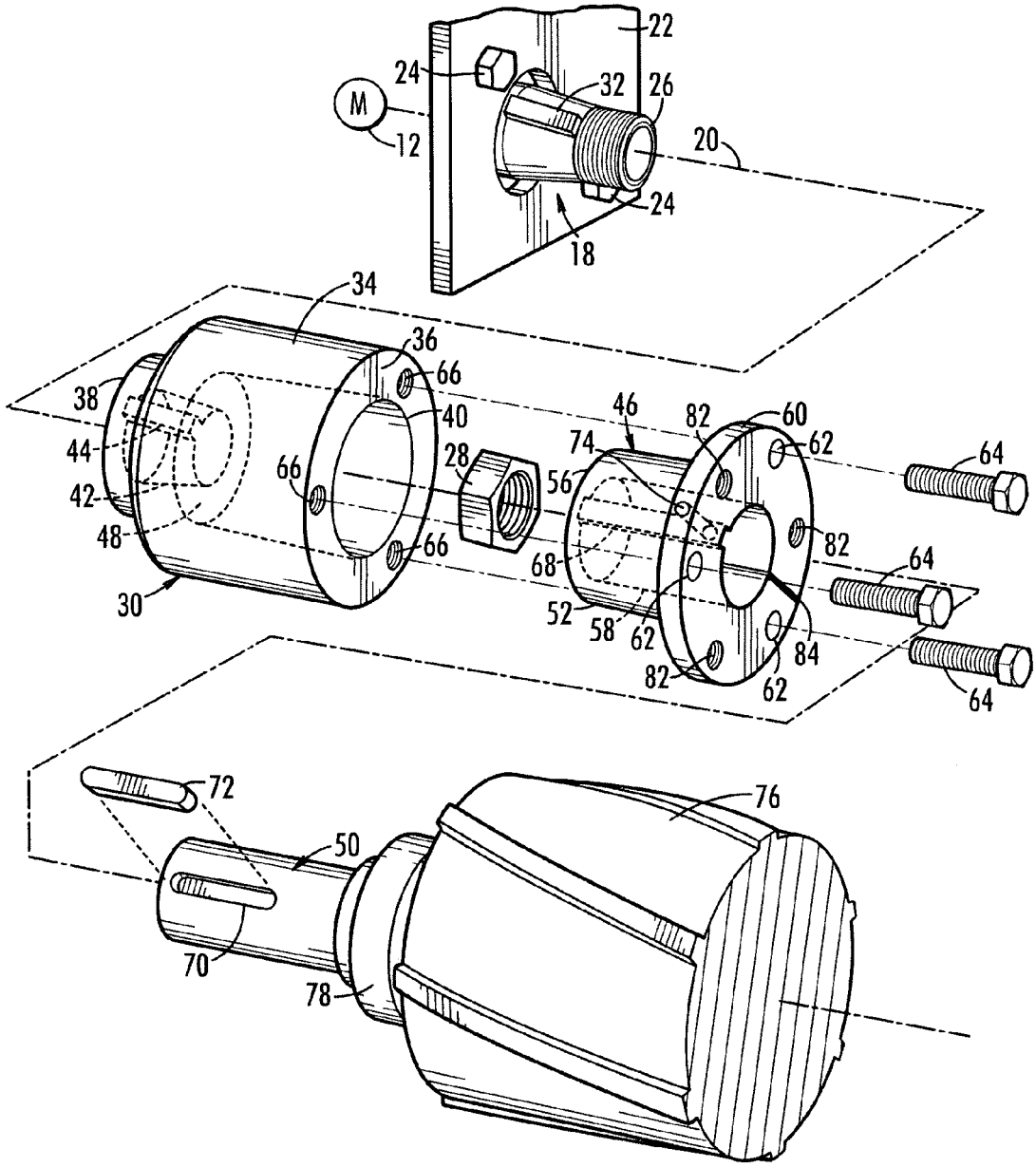
FIG. 4 is an exploded view of the coupling arrangement shown in FIG. 2 with components shown in perspective.

Tapered bushing 46 also has a flange 60 about first end 54. Referring now also to FIG. 4, there are three holes 62 defined in flange 60 through which bolts 64 extend in this embodiment. (However, any suitable number of holes and bolts could be utilized.) Bolts 64 are received in threaded holes 66 in first end 36 of first coupling element 30.

As shown, a keyway 68 is defined in bore 58. A matching keyway 70 is similarly defined in the outer surface of shaft 50. A rectangular key 72 is located in keyways 68 and 70 to prevent relative rotation between bushing 46 and shaft 50. Optionally, a threaded bore 74 is provided so that a set screw (not shown) may engage key 72. The use of the set screw may aid in the assembly of the arrangement.

As shown, feed wheel shaft 50 extends laterally from feed wheel 76 along the feed wheel's rotational axis. Shaft 50 is supported for rotation by a typical bearing assembly 78 mounted to a wall 80 of the brush chipper.

Regarding the first coupling element 30, it can be seen that first bore 40 is of a larger internal diameter than second bore 42 in the illustrated embodiment. This difference in size is due mainly to the fact that first end 36 is designed to accept a bushing with a larger outer diameter than shaft 18. The amount of taper in first bore 40 and second bore 42 is dependent upon the respective tapers of bushing 46 and shaft 18. It should be appreciated that embodiments are contemplated in which either or neither of bores 40 and 42 need be tapered.

Referring now to FIG. 4, motor 12 is represented by "M" for drawing simplicity. The perspective view of this drawing clearly shows how motor output shaft 18, mechanical coupler 30, tapered bushing 46, and feed wheel shaft 50 are assembled. Furthermore, wall 48 formed by the step at the intersection of first bore 40 and second bore 42 is more visible. It can also be seen that flange 60 of bushing 46 further defines a plurality of threaded holes 82 as well as an axial slot 84.

Figure 5:
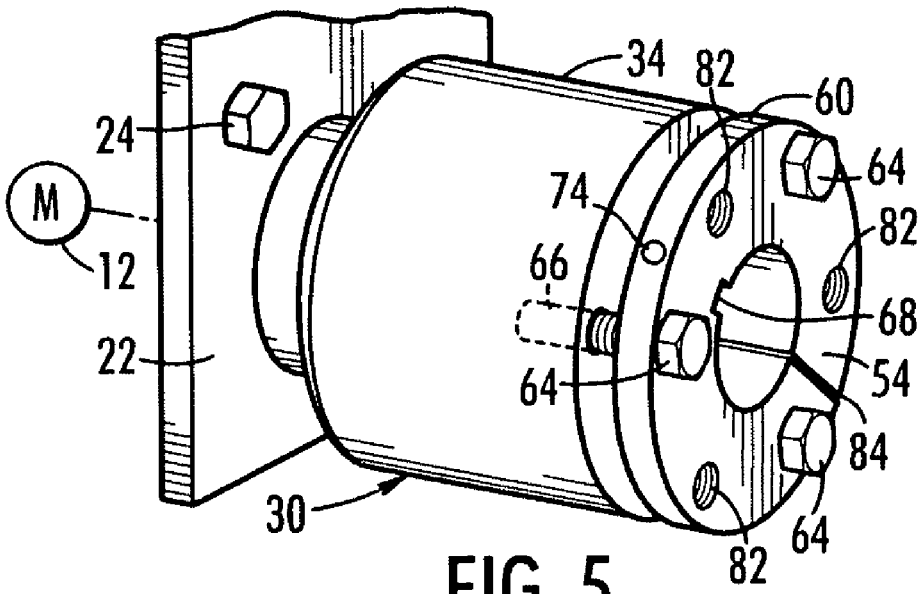
FIG. 5 is a partially assembled view of a mechanical coupling arrangement in accordance with the present invention.
Figure 6:
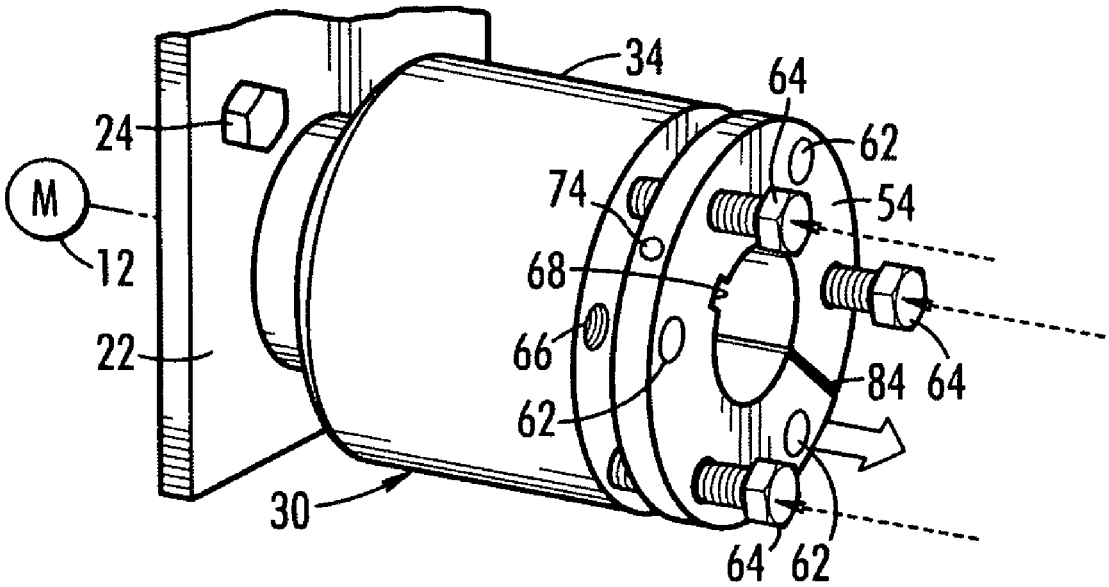
FIG. 6 shows the coupling arrangement of FIG. 5 with the bolts moved into a position to separate the first and second coupling elements.

Referring now to FIGS. 5 and 6, the motor output shaft, mechanical coupler, and bushing are shown joined together without the feed wheel shaft. Generally, the following steps are followed to connect motor output shaft 18 and coupling element 30: Coupling element 30 is slid onto motor output shaft 18. Key 32 is aligned with keyway 44 upon insertion. Nut 28 (FIGS. 2 and 3) is tightened onto threaded portion 26 of motor output shaft 18, thus securing coupling element 30 and shaft 18 together.

To connect feed wheel shaft 50 and bushing 46, bushing 46 slides onto shaft 50. Before sliding the bushing onto the feed wheel shaft, key 72 is inserted into keyway 70.

To complete the assembly of the arrangement, bushing 46 is inserted into first bore 40 of coupling element 30. To secure bushing 46 (previously installed onto shaft 50) to coupling element 30 (previously installed to motor shaft 18), three bolts 64 are inserted through holes 62 in bushing flange 60 and into holes 66 in coupling element 30. Bolts 64 are tightened to an appropriate torque to draw bushing 46 into first bore 40. As a result, bushing 46 will be connected to coupling element 30. In addition, bushing 46 will be securely tightened to shaft 50 by contraction of slot 84.

Disassembly of the coupling arrangement will now be described. First, bolts 64 are removed from holes 62 and 66. To assist in the separation of bushing 46 from coupling element 30, bolts 64 can be reinserted into threaded holes 82 (see FIG. 6). When bolts 64 are torqued, force is applied to the wall of first end 36, causing the two coupling elements to move axially apart. In this way, the shaft connection can easily be separated in the event a part needs to be replaced or the motor needs maintenance.

After bushing 46 and coupling element 30 have been separated, nut 28 may be loosened and removed. Coupling element 30 can then be easily removed from motor output shaft 18.

While parts of the mechanical coupling arrangement could be formed of various suitable materials, the preferred material of the parts is steel. Other materials, such as aluminum, iron, and other metals could be used in the same applications.

While one or more preferred embodiments of the invention have been described above, it should be understood that any and all equivalent realizations of the present invention are included within the scope and spirit thereof. The embodiments depicted are presented by way of example and are not intended as limitations upon the present invention. Thus, those of ordinary skill in this art should understand that the present invention is not limited to these embodiments since modifications can be made. Therefore, it is contemplated that any and all such embodiments are included in the present invention as may fall within the scope and spirit thereof.

What is claimed:

1. A brush chipper comprising:

a body having a cutting system, a brush outlet, and a feed opening;

a motor having an output shaft;

a feed wheel having a feed wheel shaft, said feed wheel being arranged to draw brush into the cutting system;

a coupling arrangement adapted to couple said output shaft and said feed wheel in axial alignment with each other, said coupling arrangement including:

(a) a first coupling element having first and second opposite ends, the first coupling element's second end secured to the motor output shaft, the first coupling element defining a tapered bore in the first end thereof; and (b) a second coupling element secured to the feed wheel shaft, the second coupling element having a tapered outer surface received in the tapered bore of the first coupling element.

2. The brush chipper of claim 1 wherein the second coupling element has a radial flange located axially adjacent to the tapered outer surface.

3. The brush chipper of claim 2 wherein the radial flange defines a plurality of axial holes therethrough.

4. The brush chipper of claim 3 wherein an end face of the first coupling element's first end defines a plurality of threaded holes axially aligned with the holes of the radial flange.

5. The brush chipper of claim 4 wherein the radial flange has a second plurality of holes not aligned with the threaded holes in the first coupling element.

6. The brush chipper of claim 1 wherein the second coupling element has an axial slot.

* * * * *